US010283907B2

(12) United States Patent
Matsuo et al.

(10) Patent No.: US 10,283,907 B2
(45) Date of Patent: May 7, 2019

(54) FLOATING CONNECTOR AND ELECTRONIC DEVICE MODULE

(71) Applicant: Japan Aviation Electronics Industry, Limited, Tokyo (JP)

(72) Inventors: Seiya Matsuo, Tokyo (JP); Akihiro Matsunaga, Tokyo (JP); Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/801,950

(22) Filed: Nov. 2, 2017

(65) Prior Publication Data

US 2018/0219326 A1 Aug. 2, 2018

(30) Foreign Application Priority Data

Jan. 30, 2017 (JP) ..... 2017-014697

(51) Int. Cl.

| | |
|---|---|
| ***H01R 13/64*** | (2006.01) |
| ***H01R 13/631*** | (2006.01) |
| ***H01R 12/91*** | (2011.01) |
| ***H01R 13/11*** | (2006.01) |

(52) U.S. Cl.

CPC ..... *H01R 13/6315* (2013.01); *H01R 12/91* (2013.01); *H01R 13/112* (2013.01)

(58) Field of Classification Search

CPC ..... H01R 13/6315
USPC ..... 439/247, 246, 248, 862
See application file for complete search history.

(56) References Cited

U.S. PATENT DOCUMENTS

| | | | | |
|---|---|---|---|---|
| 5,679,010 | A * | 10/1997 | Hotea | H01R 12/58 439/246 |
| 5,882,219 | A * | 3/1999 | Samejima | H01R 13/6315 439/247 |
| 6,033,245 | A * | 3/2000 | Yamkovoy | H01R 13/6315 439/246 |
| 6,319,015 | B1 | 11/2001 | Faunce | |
| 7,575,487 | B2 * | 8/2009 | Yodogawa | H01R 13/113 439/830 |
| 8,113,859 | B2 * | 2/2012 | Kim | H01R 33/02 439/239 |
| 8,317,529 | B2 * | 11/2012 | Katano | H01R 13/115 439/251 |
| 9,331,324 | B2 * | 5/2016 | Kwak | H01M 2/0473 |

(Continued)

FOREIGN PATENT DOCUMENTS

| | | |
|---|---|---|
| JP | H11339906 A | 12/1999 |
| JP | 2010-118314 A | 5/2010 |

*Primary Examiner* — Abdullah A Riyami
*Assistant Examiner* — Nelson R. Burgos-Guntin
(74) *Attorney, Agent, or Firm* — Muncy, Teissler, Olds & Lowe, P.C.

(57) ABSTRACT

A floating connector includes a base portion, a contact portion that comes into contact with a counter connector, and an arm portion that connects the base portion to the contact portion, the arm portion includes an elastically deformable portion extending from the base portion in a direction parallel to a fitting axis, a tip end of the arm portion extends in a direction intersecting the fitting axis, the contact portion is formed at the tip end of the arm portion, and the elastically deformable portion twists and deforms, whereby the contact portion is floated in an arcuate motion within a plane perpendicular to the fitting axis.

8 Claims, 10 Drawing Sheets

(56) References Cited

U.S. PATENT DOCUMENTS

| | | | | |
|---|---|---|---|---|
| 9,825,382 | B2 * | 11/2017 | Xiao | H01R 12/707 |
| 2001/0027045 | A1 * | 10/2001 | Enomoto | H01R 12/716<br>439/246 |
| 2006/0030191 | A1 * | 2/2006 | Tuin | H01R 12/57<br>439/246 |
| 2007/0037427 | A1 * | 2/2007 | Miyazono | H01R 33/0827<br>439/232 |
| 2008/0146060 | A1 * | 6/2008 | Kato | H01R 13/193<br>439/171 |
| 2008/0305695 | A1 | 12/2008 | Yodogawa | |
| 2009/0317999 | A1 * | 12/2009 | Arts | H01R 13/6315<br>439/248 |
| 2011/0151698 | A1 * | 6/2011 | Boyd | A61N 1/375<br>439/246 |

* cited by examiner

FLOATING CONNECTOR AND ELECTRONIC DEVICE MODULE

BACKGROUND OF THE INVENTION

The present invention relates to a connector and an electronic device module having a connector, particularly to a floating connector and an electronic device module having a floating connector.

A floating connector that absorbs positional misalignment of connectors when the connectors are fitted with each other has been conventionally used, and a floating connector as illustrated in FIGS. 20, 21, 22 and 23 is disclosed in JP 2010-118314 A, for example. The floating connector includes a housing 1 and a plurality of contacts 2. Each of the contacts 2 is formed of a strip-shaped metal piece that has been bent, and has a contact portion 3, a board connecting portion 4 to be connected to a board 8 and a fixing portion 5 formed between the contact portion 3 and the board connecting portion 4 and fixed to the housing 1. In addition, each of the contacts 2 has an elastic portion 7 made of an arm portion 6 that connects the fixing portion 5 to the board connecting portion 4 and that is bent by 180°; the contacts 2 fixed to the housing 1 operate together.

The arm portion 6 including the elastic portion 7 elastically expands and contracts in a connector connecting direction D1 so that the housing 1 is capable of linearly floating along the connector connecting direction D1. Moreover, as illustrated in FIG. 23, the arm portion 6 including the elastic portion 7 elastically twists and deforms so that the housing 1 is capable of linearly floating along a direction D3 perpendicular to the connector connecting direction D1.

In order for the floating connector disclosed by JP 2010-118314 A to float with a reduced external force that is applied when being fitted with a counter connector, the arm portion 6 including the elastic portion 7 needs to have a length long enough to be readily elastically deformable.

Meanwhile, as illustrated in FIG. 22 where the housing 1 is not applied with an external force along the direction D3 and in FIG. 23 where the housing 1 is applied with an external force along the direction D3, when the housing 1 linearly floats along the direction D3, only the elastic portion 7 at which the arm portion 6 is bent by 180° twists and deforms, while other portions of the arm portion 6 extending along a direction D2 do not elastically deform. Accordingly, the elastic portion 7 at which the arm portion 6 is bent by 180° needs to have a long length in the connector connecting direction D1 in order to decrease the force the housing 1 requires to float along the direction D3, and thus there is a problem that the mounting area of the floating connector in the connector connecting direction D1 becomes large.

SUMMARY OF THE INVENTION

The present invention has been made to overcome the conventional problem and provide a floating connector in which the force required for floating movements can be freely designed while the mounting area is kept to be small.

A floating connector that absorbs positional misalignment of a counter connector when the counter connector is fitted along a fitting axis, the floating connector comprising:

a base portion;

a contact portion that comes into contact with the counter connector; and an arm portion that connects the base portion to the contact portion, wherein the arm portion includes an elastically deformable portion extending from the base portion in a direction parallel to the fitting axis, wherein a tip end of the arm portion extends in a direction intersecting the fitting axis, wherein the contact portion is formed at the tip end of the arm portion, and wherein the elastically deformable portion twists and deforms, whereby the contact portion is floated in an arcuate motion within a plane perpendicular to the fitting axis.

An electronic device module according to present invention comprising a plurality of floating connectors, each of which is the floating connector as described above, wherein the contact portions of the plurality of floating connectors are independently electrically connected to a plurality of counter connectors in a garment-side connector, whereby the electronic device module is used as a wearable device.

DETAILED DESCRIPTION OF THE INVENTION

Embodiment 1

Embodiments of the present invention are described below based on the appended drawings.

Figure 1:
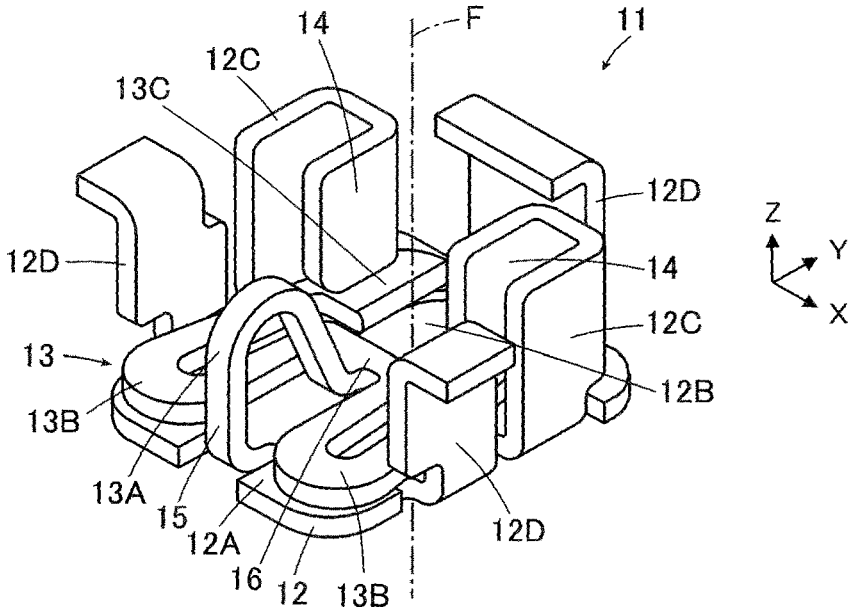
FIG. 1 is a perspective view of a floating connector according to Embodiment 1 of the present invention when viewed obliquely from above.
Figure 2:
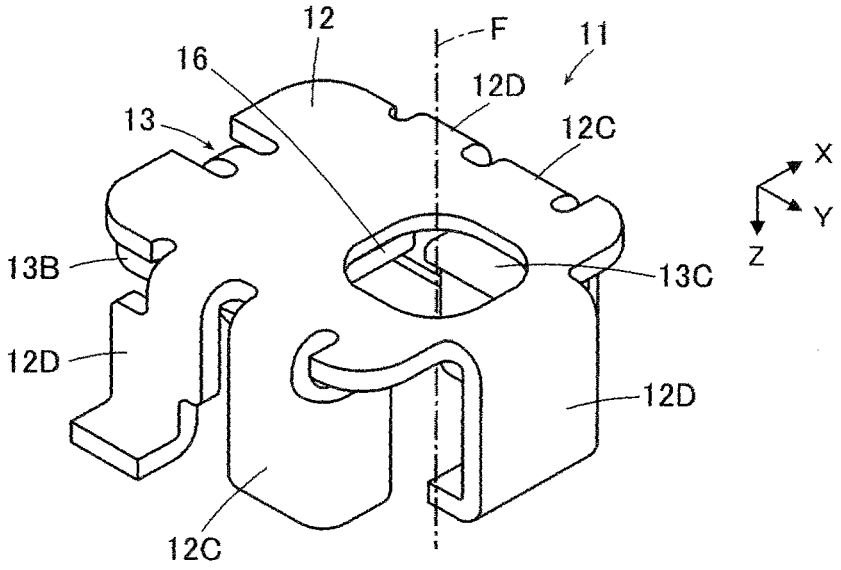
FIG. 2 is a perspective view of the floating connector according to Embodiment 1 when viewed obliquely from the bottom.

FIG. 1 is a perspective view of a floating connector 11 according to Embodiment 1 when viewed from above. Meanwhile, FIG. 2 is a perspective view of the floating connector 11 when viewed from the bottom. The floating connector 11 is formed of a single bent metal sheet, and the floating connector 11 includes a base portion 12 in a flat plate shape, an arm portion 13 extending from one end of the base portion 12, and a pair of contact portions 13C formed at tip ends of the arm portion 13.

For convenience, when a surface 12A of the base portion 12 extends along the XY plane, a direction perpendicular to the surface 12A and extending from the base portion 12 toward the arm portion 13 is defined as "+Z direction", and a direction opposite to the +Z direction is defined as "−Z direction."

As illustrated in FIG. 2, the base portion 12 of the floating connector 11 is provided with an opening portion 12B whose center is a fitting axis F extending perpendicularly to the surface 12A. The base portion 12 is also provided with a pair of contact guide portions 12C extending in the +Z direction independently from the +X directional end and the −X directional end of the base portion 12 and facing each other across the opening portion 12B, and three board mounting portions 12D extending from the base portion 12 in the +Z direction and positioned on the same XY plane.

Figure 3:
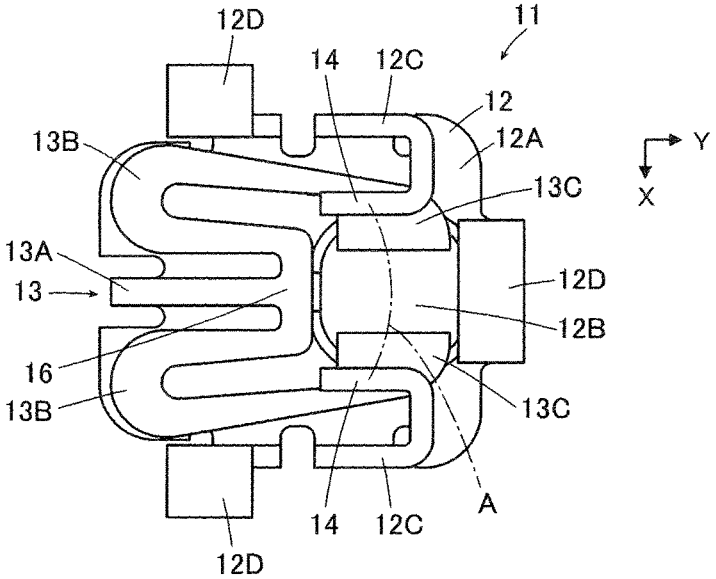
FIG. 3 is a plan view of the floating connector according to Embodiment 1 when viewed from above.

FIG. 3 is a plan view of the floating connector 11 viewed from the +Z direction. As illustrated in FIGS. 1 and 3, the arm portion 13 of the floating connector 11 includes a root portion 13A extending from the −Y directional end of the base portion 12 in the +Z direction and then bending toward the −Z direction, and a pair of branched portions 13B extending from the +Y directional end of the root portion 13A along the surface 12A of the base portion 12. The contact portions 13C are independently formed at tip ends of the branched portions 13B and are arranged so as to face each other across the fitting axis F that passes the center of the opening portion 12B. That is, the contact portions 13C are connected to the base portion 12 via the arm portion 13. In addition, the arm portion 13 is bent such that the surface 12A of the base portion 12 and the pair of contact portions 13C are arranged in parallel with each other.

The opening portion 12B is a hole which is formed in the base portion 12 at a position closer to the +Y directional end of the base portion 12 and to which a contact such as a plug of a counter connector (not shown) is inserted.

The pair of contact guide portions 12C formed on the base portion 12 prevent the contact portions 13C independently formed at the tip ends of the pair of branched portions 13B of the arm portion 13 from excessively shifting in the +Z direction. The pair of contact guide portions 12C have bent portions 14 independently extending from the +X directional end and the −X directional end of the base portion 12 in the +Z direction and bent from the +Y direction toward the −Y direction, and the contact guide portions 12C are arranged so as to face each other across the opening portion 12B. The bent portions 14 of the contact guide portions 12C are arranged such that the −Z directional ends of the bent portions 14 are located to be slightly deviated away in the +Z direction from the contact portions 13C of the pair of branched portions 13B and come into contact with the contact portions 13C which have shifted in the +Z direction, thereby preventing the contact portions 13C from excessively shifting.

The three board mounting portions 12D are for use in mounting and electrically connecting the floating connector 11 to a board (not shown). The board mounting portions 12D are electrically connected to the board (not shown) by means of, for example, soldering and welding.

The root portion 13A of the arm portion 13 extends from the −Y directional end of the base portion 12 in the +Z direction and then bends toward the −Z direction. The root portion 13A includes, at its part extending in the +Z direction, an elastically deformable portion 15 extending in the +Z direction, i.e., in parallel with the fitting axis F. The elastically deformable portion 15 can elastically twist and deform having the elastically deformable portion 15 itself as a center; when the elastically deformable portion 15 is designed to have the longer length in the Z direction, the stress applied on the elastically deformable portion 15 is dispersed, and the elastically deformable portion 15 can more flexibly twist and deform.

The pair of branched portions 13B of the arm portion 13 are branched from the +Y directional end of the root portion 13A toward the +X direction and the −X direction, independently, and extend toward the −Y direction and then toward the +Y direction. Since being designed to have long arms in the Y direction as above, the pair of branched portions 13B can flexibly deform in the +X direction and the −X direction, independently, when receiving external forces in the +X direction and the −X direction.

Figure 4:
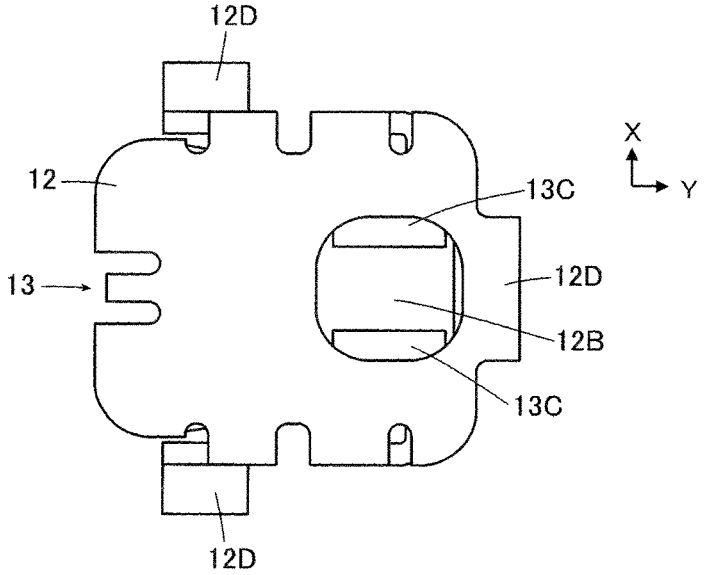
FIG. 4 is a bottom view of the floating connector according to Embodiment 1 when viewed from the bottom.

FIG. 4 is a plan view of the floating connector 11 in Embodiment 1 when viewed from the −Z direction. As illustrated in FIGS. 3 and 4, a base end part 16 of the pair of branched portions 13B of the arm portion 13, i.e., a part where the pair of branched portions 13B start to split from the +Y directional end of the root portion 13A into two, is preferably not included inside the opening portion 12B of the base portion 12 when the floating connector 11 is viewed from the +Z direction and the −Z direction. In other words, when the floating connector 11 is viewed from the +Z direction and the −Z direction, the base end part 16 of the pair of branched portions 13B is preferably located outside of the opening portion 12B of the base portion 12. Since the base end part 16 of the pair of branched portions 13B is disposed in this manner, a contact of a counter connector (not shown) that is inserted from the outside does not come into contact with the base end part 16 of the pair of branched portions 13B, whereby the arm portion 13 does not receive an external force in the −Y direction, and the elastically deformable portion 15 is prevented from elastically expanding and contracting within the XY plane.

The contact portions 13C separately provided at tip ends of the pair of branched portions 13B are to come into contact with a contact of a counter connector (not shown) that is inserted in the opening portion 12B of the base portion 12, thereby electrically connecting the floating connector 11 to the counter connector.

As illustrated in FIGS. 3 and 4, the contact portions 13C separately formed at the tip ends of the pair of branched portions 13B are arranged to face each other across the fitting axis F. In addition, the pair of contact portions 13C have a predetermined length in the Y direction. Further, the contact portions 13C are arranged such that when the floating connector 11 is viewed from the +Z direction and the −Z direction, the tip ends of the contact portions 13C are included inside the opening portion 12B formed in the base portion 12.

Figure 5:
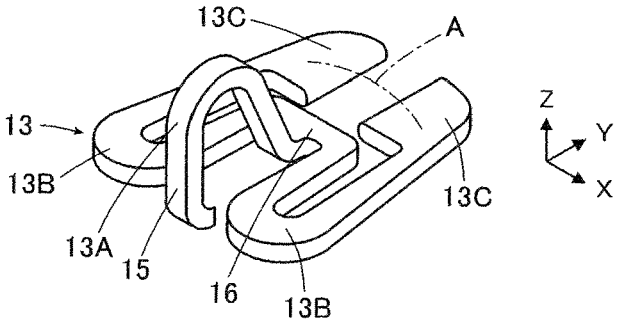
FIG. 5 is a perspective view of an arm portion of the floating connector according to Embodiment 1.

Since the arm portion 13 is configured as above, when an insertion position of a contact of a counter connector (not shown) to be inserted in the opening portion 12B of the base portion 12 is misaligned from the fitting axis F in the X direction, the elastically deformable portion 15 included in the root portion 13A of the arm portion 13 twists and deforms within the XY plane. At this time, as illustrated in FIG. 5, the contact portions 13C separately formed at the pair of branched portions 13B are floated in an arcuate motion along an arc A within a plane parallel to the XY plane. Note that FIG. 5 only shows the arm portion 13 among the constituent components of the floating connector 11. Moreover, even if the insertion position of a contact of a counter connector is misaligned from the fitting axis F in the Y direction, the pair of contact portions 13C can come into contact with the contact of the counter connector owing to their predetermined length in the Y direction. Accordingly, the floating connector 11 can absorb positional misalignment of a contact of a counter connector in the X and Y directions.

In addition, as the elastically deformable portion 15 is designed to have a longer length in the Z direction, the stress applied on the elastically deformable portion 15 when the insertion position of a contact of a counter connector is misaligned from the fitting axis F is dispersed, and the elastically deformable portion 15 can more flexibly twist and deform. Hence, the floating connector 11 is not required to have a large mounting area, i.e., long lengths in the X direction and the Y direction.

Accordingly, the floating connector 11 in Embodiment 1 as described above allows the force necessary for floating movements to be freely designed while keeping the small mounting area in the X direction and the Y direction.

While the floating connector 11 is described as being formed of a single bent metal sheet in the foregoing, the floating connector 11 does not have to be formed of a single metal sheet as long as the pair of branched portions 13B of the arm portion 13 can flexibly deform within the XY plane, the elastically deformable portion 15 included in the root portion 13A of the arm portion 13 can elastically twist and deform around an axis extending in parallel with the fitting axis F, and each of the contact portions 13C is electrically connected to the board mounting portion 12D. For instance, if the floating connector 11 has electric wiring between each of the contact portions 13C and the board mounting portion 12D through plating or the like, the floating connector 11 may be formed using an insulating material such as an insulating resin, or partly using an insulating material and a conductive material such as metal.

For the sake of explanation, the pair of branched portions 13B and the surface 12A of the base portion 12 are described as being parallel to each other in the foregoing. However, the pair of branched portions 13B may not be parallel to the surface 12A of the base portion 12 but may extend in a direction intersecting the fitting axis F as long as the pair of branched portions 13B can flexibly deform within the XY plane.

Furthermore, the pair of contact portions 13C are described as being parallel to the surface 12A of the base portion 12 in the foregoing. However, the pair of contact portions 13C may not be parallel to the surface 12A of the base portion 12 but may be inclined relative to the fitting axis F.

Embodiment 2

Figure 6:
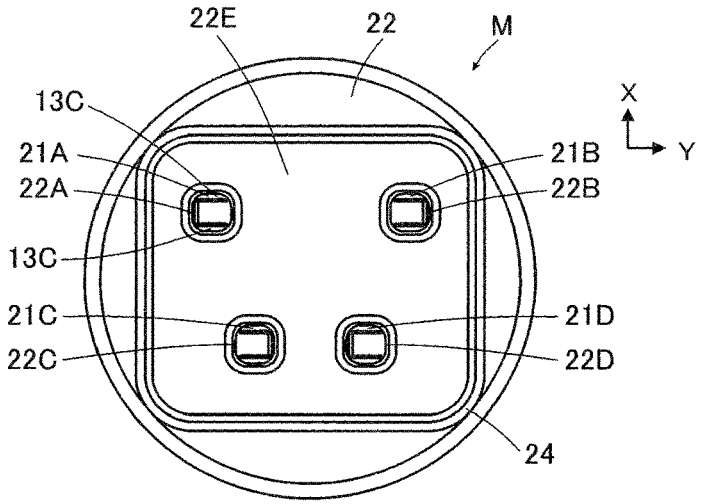
FIG. 6 is a bottom view of an electronic device module according to Embodiment 2 when viewed from the bottom.
Figure 7:
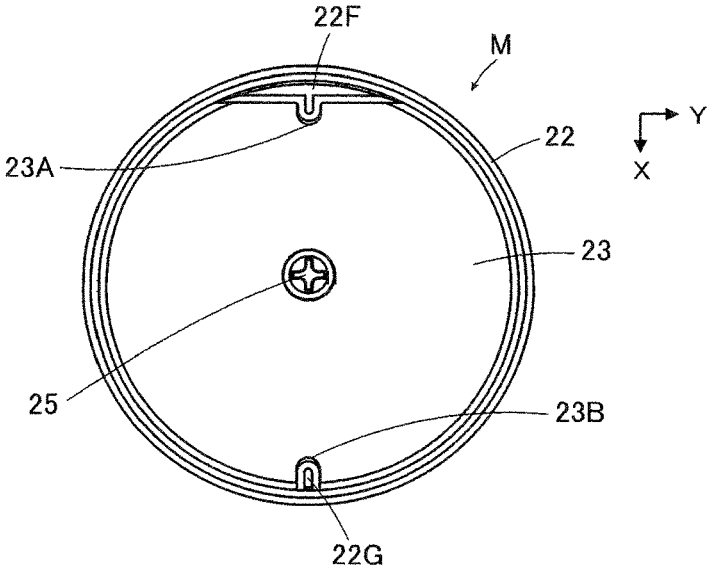
FIG. 7 is a plan view of the electronic device module according to Embodiment 2 when viewed from above.
Figure 8:
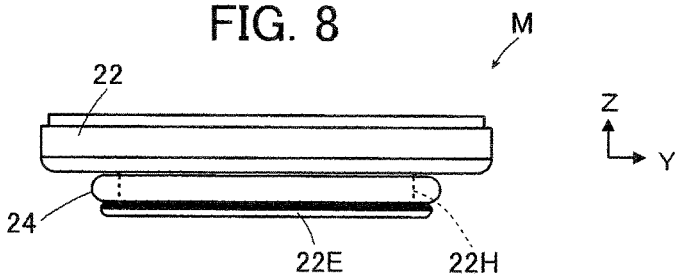
FIG. 8 is a side view of the electronic device module according to Embodiment 2.

FIGS. 6 to 8 illustrate an electronic device module M according to Embodiment 2. The electronic device module M is an electronic device module including four floating connectors 21A, 21B, 21C and 21D, each having the same configuration as that of the floating connector 11 shown in FIGS. 1 to 4. Hence, constituent elements of the floating connectors 21A to 21D are described using the same reference symbols as those of the constituent elements of the floating connector 11 shown in FIGS. 1 to 4 in the following description. In addition, the X, Y and Z directions are defined based on the floating connector 21A in the following description. That is, similarly to the foregoing explanation as to the floating connector 11 shown in FIGS. 1 to 4, the surface 12A of the base portion 12 in the floating connector 21A extends along the XY plane, and a direction perpendicular to the surface 12A of the base portion 12 in the floating connector 21A and extending from the base portion 12 toward the arm portion 13 in the floating connector 21A is defined as +Z direction.

As illustrated in FIGS. 6 to 8, the electronic device module M includes a housing 22 formed of an insulating material such as an insulating resin, a board 23 to which the floating connectors 21A to 21D are to be electrically connected, and a gasket 24. The board 23 is fixed to the housing 22 with a screw 25.

The housing 22 of the electronic device module M has a rectangular convex portion 22E in a substantially-rectangular shape protruding in the −Z direction, and in the rectangular convex portion 22E, housing opening portions 22A, 22B, 22C and 22D corresponding in size to the opening portions 12B formed in the base portions 12 in the floating connectors 21A to 21D are formed. As illustrated in FIG. 6, the housing opening portions 22A to 22D are designed to be arranged symmetrically in the Y direction but asymmetrically in the X direction, whereby orientation of the electronic device module M within the XY plane is determined. In FIG. 6, the housing opening portions 22A to 22D are formed such that the distance between the housing opening portions 22A and 22B is longer than the distance between the housing opening portions 22C and 22D. In addition, as illustrated in FIG. 6, the two contact portions 13C of each of the floating connectors 21A to 21D are exposed through the housing opening portions 22A to 22D in the housing 22.

As illustrated in FIG. 7, the housing 22 of the electronic device module M includes, at its +Z directional end, a projection 22F formed on the −X direction side and a projection 22G on the +X direction side. The projection 22F is in a fan-like shape and is formed at the −Z directional end on the −X direction side of the housing 22 where the housing opening portions 22C and 22D are located. Meanwhile, the projection 22G is not in a fan-like shape and is formed at the −Z directional end on the −X direction side of the housing 22 where the housing opening portions 22A and 22B are located. With this configuration, a user of the electronic device module M can perceive the projections 22F and 22G formed at the +Z directional end of the housing 22 and thus can find the rotational position of the electronic device module M in the XY plane.

The housing 22 includes the projections 22F and 22G at the +Z directional end thereof as above, and accordingly, the board 23 to be attached to the housing 22 from the +Z direction is provided with a cutout 23A and a cutout 23B formed in conformity with the projection 22F and the projection 22G, respectively.

Moreover, as illustrated in FIG. 8, a rectangular small-diameter portion 22H having an outer diameter smaller than the outer diameter of the rectangular convex portion 22E is provided at a root part of the rectangular convex portion 22E of the housing 22, and the gasket 24 is attached to the rectangular small-diameter portion 22H.

Figure 9:
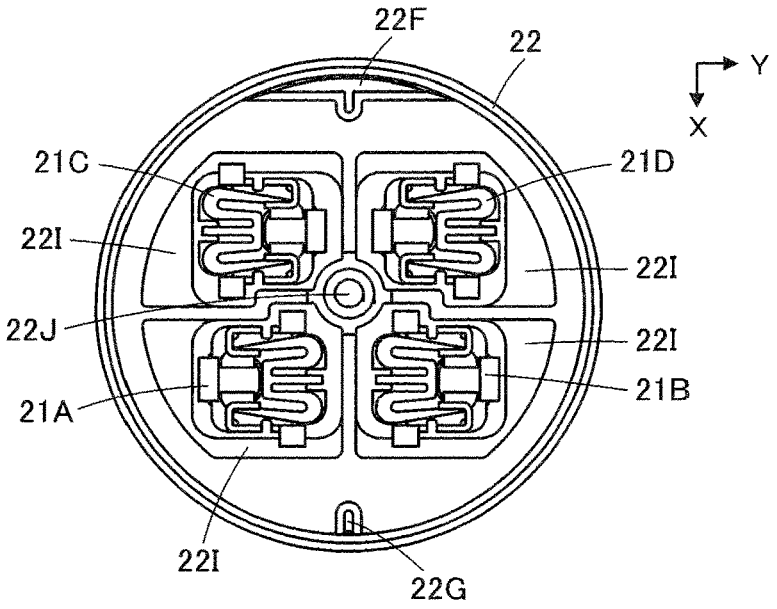
FIG. 9 is a plan view of the electronic device module according to Embodiment 2, from which a board is removed, when viewed from above.

FIG. 9 is a partial cross-sectional view of the electronic device module M from which the board 23 and the screw 25 are removed and which is viewed from the +Z direction. As illustrated in FIG. 9, the housing 22 of the electronic device module M is provided with four connector accommodation rooms 221 which open toward the +Z direction and in which the floating connectors 21A to 21D are independently accommodated. By being accommodated independently in the four connector accommodation rooms 221, the floating connectors 21A to 21D are insulated from one another. In addition, at the center area among the four connector accommodation rooms 221, formed is a screw hole 22J into which the screw 25 is screwed.

The floating connectors 21A to 21D are accommodated in the four connector accommodation rooms 221 in such a manner that the floating connectors 21A to 21D face differently from one another. For example, as illustrated in FIG. 9, each two floating connectors neighboring in the X direction and the Y direction face in opposite directions along the Y direction. Owing to the arrangement of the floating connectors 21A to 21D as above, the opening portions 12B of the floating connectors 21A to 21D can be positioned symmetrically only in the Y direction as with the locations where the housing opening portions 22A to 22D of the housing 22 are formed.

Figure 10:
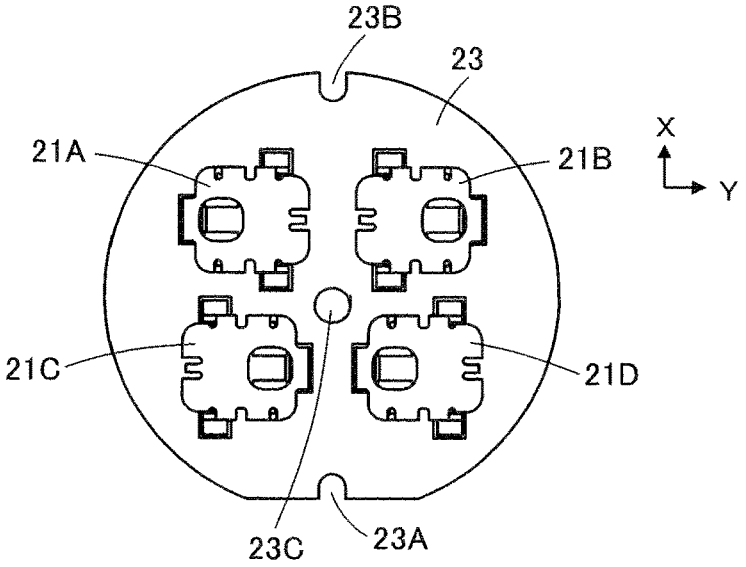
FIG. 10 is a bottom view of the board, on which four floating connectors are mounted, when viewed from the bottom.

FIG. 10 is a plan view of the board 23 on which the floating connectors 21A to 21D are mounted, when viewed from the −Z direction. At the center area of the board 23, i.e., at the center area among the four arranged floating connectors 21A to 21D on the substrate 23, formed is a hole 23C through which the screw 25 is inserted.

Figure 11:
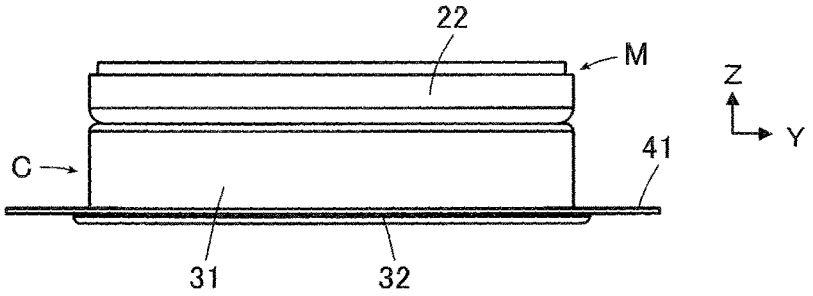
FIG. 11 is a side view of the electronic device module according to Embodiment 2 and a counter module as being connected to each other.
Figure 12:
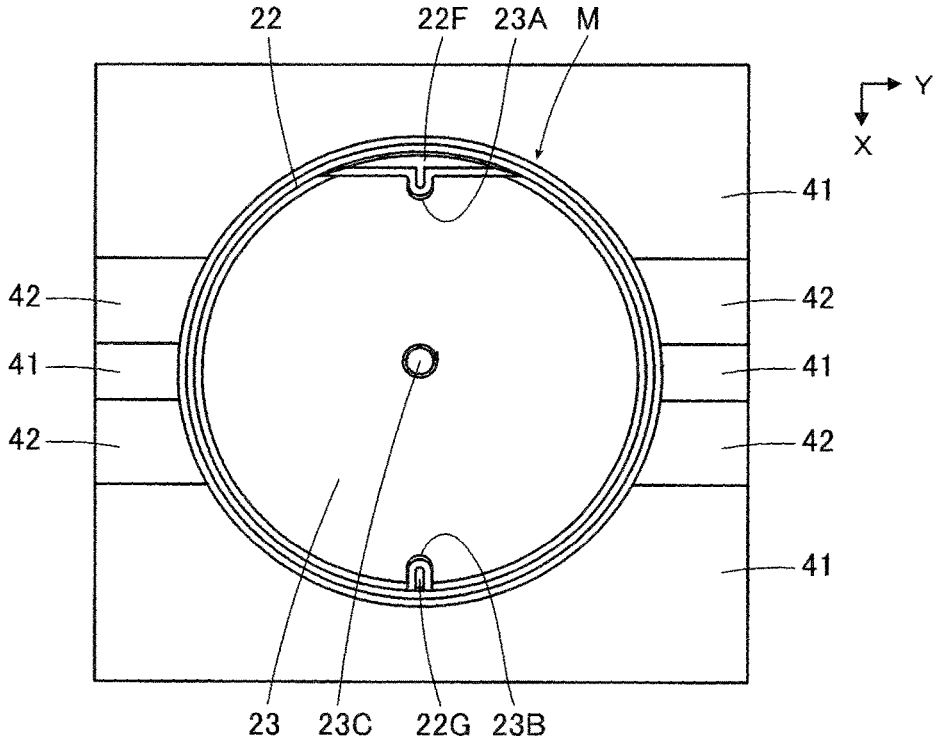
FIG. 12 is a plan view of the electronic device module according to Embodiment 2 and the counter module as being connected to each other, when viewed from above.

Below described is a usage example of the electronic device module M according to Embodiment 2, with reference to the appended drawings. FIGS. 11 and 12 illustrate the electronic device module M connected to a counter module C.

As illustrated in FIG. 11, the electronic device module M is connected to the counter module C, and a sheet-like member 41 is attached to the counter module C. The counter module C includes an upper housing 31 and a lower housing 32 both made of an insulating material such as an insulating resin, and the upper housing 31 and the lower housing 32 hold the sheet-like member 41 therebetween.

In addition, as illustrated in FIG. 12, conductive layers 42 made of a conductive material such as conductive fibers are formed on the sheet-like member 41 and are electrically connected to the counter module C.

Figure 13:
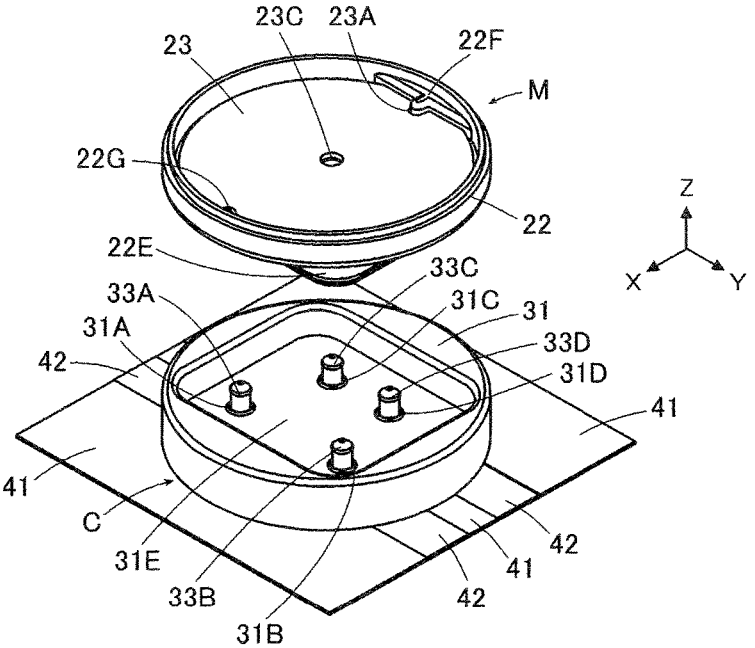
FIG. 13 is a perspective view of the electronic device module according to Embodiment 2 and the counter module before being connected to each other.

FIG. 13 shows the electronic device module M and the counter module C before being connected to each other. As illustrated in FIG. 13, the upper housing 31 of the counter module C is provided with a rectangular concave portion 31E in a substantially rectangular shape to be fitted with the rectangular convex portion 22E formed in the housing 22 of the electronic device module M. In the rectangular concave portion 31E, counter opening portions 31A, 31B, 31C and 31D are formed at positions to be superposed with the housing opening portions 22A to 22D formed in the rectangular convex portion 22E of the electronic device module M when the electronic device module M is attached to the counter module C. In addition, conductive connector pins 33A, 33B, 33C and 33D protrude from the counter opening portions 31A to 31D, respectively. The connector pins 33A to 33D are electrically connected to the conductive layers 42 of the sheet-like member 41.

When the electronic device module M and the counter module C as above are connected to each other as illustrated in FIG. 11, the connector pins 33A to 33D of the counter module C come into contact with the floating connectors 21A to 21D provided at the electronic device module M, whereby the electronic device module M and the counter module C are electrically connected to each other. Moreover, since the gasket 24 attached to the electronic device module M tightly adheres to the rectangular convex portion 22E of the electronic device module M and the rectangular concave portion 31E of the counter module C while the electronic device module M and the counter module C are connected to each other, the housing opening portions 22A to 22D formed in the rectangular convex portion 22E and the counter opening portions 31A to 31D formed in the rectangular concave portion 31E can be prevented from water entry from the outside.

Ideally, the housing opening portions 22A to 22D formed in the rectangular convex portion 22E of the electronic device module M and the counter opening portions 31A to 31D formed in the rectangular concave portion 31E of the counter module C are located at the same positions in the XY plane when the electronic device module M is connected to the counter module C. However, particularly in the case where plural housing opening portions and counter opening portions are formed, they may have positional misalignment caused in the manufacturing process. Even if the housing opening portions 22A to 22D and the counter opening portions 31A to 31D are formed at misaligned positions as above, the floating connectors 21A to 21D provided at the electronic device module M are floated when the connector pins 33A to 33D of the counter module C are inserted into the corresponding opening portions 12B of the base portions 12, whereby the floating connectors 21A to 21D can be fitted with the connector pins 33A to 33D.

When the counter module C is configured as a garment-side connector to be attached to a garment, the electronic device module M can be used as a wearable device to be connected to the garment-side module.

While the electronic device module M in Embodiment 2 as illustrated in FIGS. 6 to 10 includes four floating connectors 21A to 21D, the number of the floating connectors may be three or less or five or more.

In addition, as long as the electronic device module M includes a same floating connector as the floating connector 11 in Embodiment 1 that was described with reference to FIGS. 1 to 4 and the floating connector can be fitted with a contact such as a connector pin of a counter connector, the shape of the electronic device module M is not particularly limited to the one that has been described with reference to FIGS. 6 to 13.

Moreover, as long as the floating connectors 21A to 21D can be fitted with the contacts such as connector pins of the counter connector, orientations of the floating connectors 21A to 21D arranged on the electronic device module M in Embodiment 2 are not particularly limited.

Embodiment 3

While in the floating connector 11 in Embodiment 1, the elastically deformable portion 15 included in the root portion 13A of the arm portion 13 is designed to be elongated in the +Z direction, the floating connector can be thinned by designing the elastically deformable portion 15 to be short in the Z direction.

Figure 14:
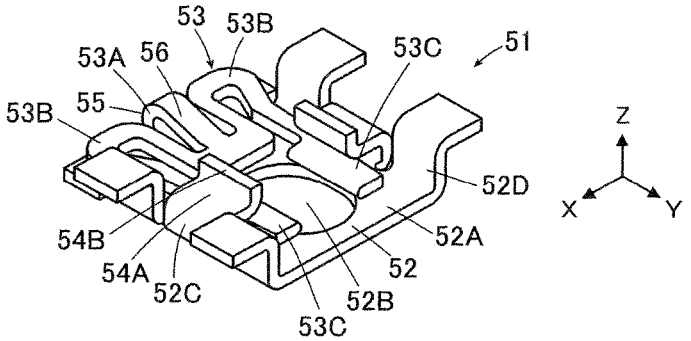
FIG. 14 is a perspective view of a floating connector according to Embodiment 3 when viewed from above.
Figure 15:
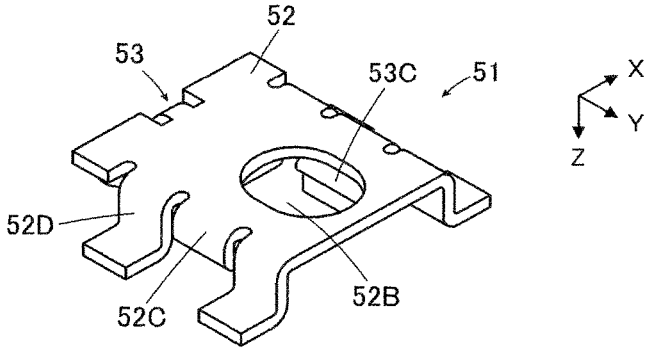
FIG. 15 is a perspective view of the floating connector according to Embodiment 3 when viewed from the bottom.

FIGS. 14 and 15 illustrate perspective views of a floating connector 51 according to Embodiment 3. While the pair of contact guide portions 12C and the pair of board mounting portions 12D of the base portion 12 as well as the root portion 13A and the elastically deformable portion 15 of the arm portion 13 of the floating connector 11 according to Embodiment 1 as illustrated in FIGS. 1 to 4 are differently shaped in the floating connector 51, other constituent elements are common between the floating connector 11 according to Embodiment 1 and the floating connector 51 according to Embodiment 3. Hence, detailed description of the constituent elements of the floating connector 51 identical to those of the floating connector 11 according to Embodiment 1 are omitted below.

The floating connector 51 is formed of a single bent metal sheet and includes a base portion 52 and an arm portion 53.

The base portion 52 of the floating connector 51 includes a surface 52A extending along the XY plane. The base portion 52 is provided with an opening portion 52B whose center is the fitting axis F extending perpendicularly to the XY plane, a pair of contact guide portions 52C and four board mounting portions 52D independently extending in the +Z direction from the +X directional end and the −X directional end of the base portion 52.

As with the arm portion 13 of the floating connector 11 in Embodiment 1, the arm portion 53 includes a root portion 53A and a pair of branched portions 53B extending from the −Y directional end of the base portion 52 along the surface 52A of the base portion 52, and contact portions 53C are separately formed at tip ends of the pair of branched portions 53B. In addition, the root portion 53A of the arm portion 53 includes an elastically deformable portion 55 extending in the +Z direction for a short length and a gently inclined portion 56 inclined toward the −Z direction.

As with the pair of contact guide portions 12C of the floating connector 11 in Embodiment 1, the pair of contact guide portions 52C of the base portion 52 prevent the contact portions 53C independently formed at the tip ends of the pair of branched portions 53B of the arm portion 53 from excessively shifting in the +Z direction. The pair of contact guide portions 52C independently extend from the +X directional end and the −X directional end of the base portion 52 and are bent so as to face each other across the opening portion 52B of the base portion 52. In other words, each of the pair of contact guide portions 52C is formed so as to include a first bent portion 54A, which is first bent toward the +Z direction and then bent in the X direction toward the opening portion 52B of the base portion 52, and a second bent portion 54B, which is made of a tip end of the first bent portion 54A that is bent toward the +Z direction.

A distance between the first bent portion 54A of each of the contact guide portions 52 and the surface 52A of the base portion 52 is preferably slightly larger than a thickness of the contact portions 53C independently formed at the tip ends of the pair of branched portions 53B of the arm portion 53. In addition, since the pair of contact guide portions 52C are each provided with the second bent portion 54E, only the two contact portions 53C can be included within the opening portion 52B of the base portion 52 when the floating connector 51 is viewed from the +Z direction and the −Z direction.

As with the board mounting portions 12D in Embodiment 1 as illustrated in FIGS. 1 to 4, the four board mounting portions 52D of the base portion 52 are for use in electrically connecting the floating connector 51 to a board (not shown). The four board mounting portions 52D are separately formed adjacent to the pair of contact guide portions 52C on the +Y direction side and on the −Y direction side, and tip ends of the board mounting portions 52D are bent in the X direction toward the outside of the floating connector 51.

The root portion 53A of the arm portion 53 includes the elastically deformable portion 55 located lower in the +Z direction than the root portion 13A of the arm portion 13 of the floating connector 11 in Embodiment 1 and extending in the +Z direction for a short length, and the inclined portion 56 gently inclined toward the −Z direction. Even when the elastically deformable portion 55 of the root portion 53A of the arm portion 53 is short and the root portion 53A has the gently inclined portion 56 as above, the elastically deformable portion 55 can elastically twist and deform within the XY plane as having itself as the center.

In addition, by designing the pair of contact guide portions 52C and the four board mounting portions 52D of the base portion 52 to be short in the +Z direction in conformity to the height in the +Z direction of the root portion 53A of the arm portion 53, the floating connector 51 can be shorter in the +Z direction. Accordingly, the floating connector 51 in Embodiment 3 can be thinned in the height direction, i.e., in the +Z direction and can also float.

Embodiment 4

While the floating connector 11 in Embodiment 1 as illustrated in FIGS. 1 to 4 and the floating connector 51 in Embodiment 3 as illustrated in FIGS. 14 and 15 are each formed of a single bent metal sheet, the floating connector of the present invention may be composed of a plurality of members.

Figure 16:
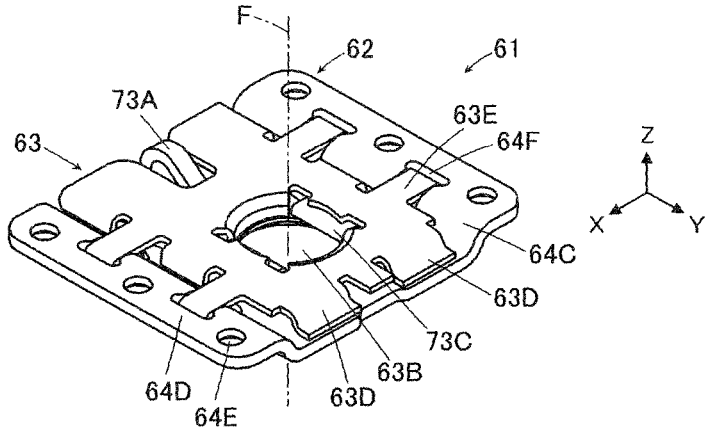
FIG. 16 is a perspective view of a floating connector according to Embodiment 4 when viewed from above.
Figure 17:
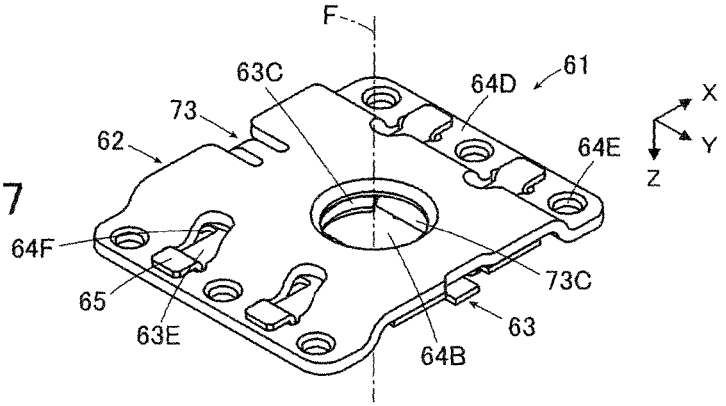
FIG. 17 is a perspective view of the floating connector according to Embodiment 4 when viewed from the bottom.

FIGS. 16 and 17 illustrate a floating connector 61 according to Embodiment 4. The floating connector 61 is composed of two separate members, i.e, a connector body 62 and a guide member 63 being fitted with each other. The connector body 62 and the guide member 63 are each formed of a single bent metal sheet.

Figure 18:
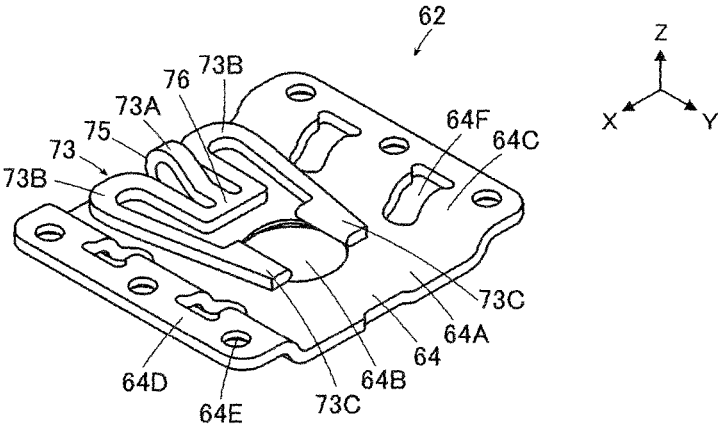
FIG. 18 is a perspective view of a connector body of the floating connector according to Embodiment 4.

FIG. 18 illustrates the connector body 62 of the floating connector 61. The connector body 62 includes a base portion 64 and an arm portion 73, and the arm portion 73 and its constituent elements are identical to those of the floating connector 11 in Embodiment 1 as illustrated in FIGS. 1 to 4. That is, the arm portion 73 includes a root portion 73A extending from the base portion 64 in the +Z direction and then bends in the −Z direction, a pair of branched portions 73B extending along a surface 64A of the base portion 64, and contact portions 73C independently formed at tip ends of the pair of branched portions 73B. The root portion 73A of the arm portion 73 includes, at its part extending in the +Z direction, an elastically deformable portion 75. The pair of branched portions 73B of the arm portion 73 have a base end part 76 where the pair of branched portions 73B start to split into two.

The base portion 64 of the connector body 62 has the surface 64A, on the +Z direction side, extending in parallel with the XY plane. The base portion 64 is provided with a body opening portion 64B into which a contact of a counter connector (not shown) is inserted, a pair of bending-extending portions 64C extending in the +Z direction, and a pair of flat plate portions 64D independently formed at tip ends of the pair of bending-extending portions 64C. On the +X direction side and the −X direction side of the base portion 64, the pair of bending-extending portions 64C independently extend in the +Z direction as bending in the X direction toward the outside of the connector body 62. Opposite surfaces of the pair of flat plate portions 64D on the +Z direction side and the −Z direction side are in parallel with the XY plane.

Each of the pair of flat plate portions 64D of the base portion 64 is provided with three fastening holes 64E to connect the connector body 62 to a board (not shown) by means of screws or the like made of a conductive material such as metal. In addition, each of the pair of bending-extending portions 64C is provided with two fixing holes 64F to fix the guide member 63 to the connector body 62.

Figure 19:
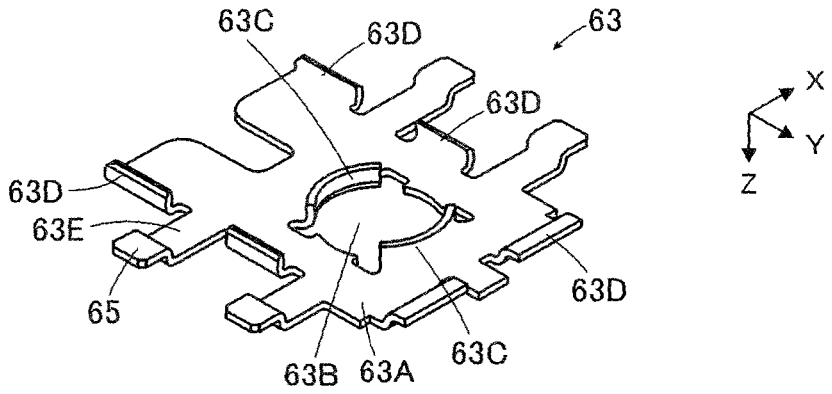
FIG. 19 is a perspective view of a guide member of the floating connector according to Embodiment 4.
Figure 20:
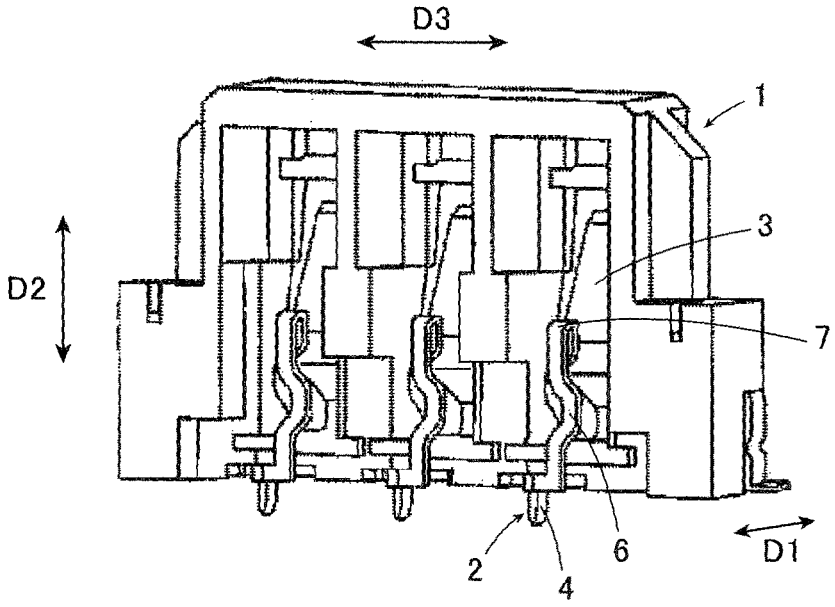
FIG. 20 PRIOR ART
FIG. 20 is a perspective view of a conventional floating connector disclosed in JP 2010-118314 A when viewed from the back.
Figure 21:
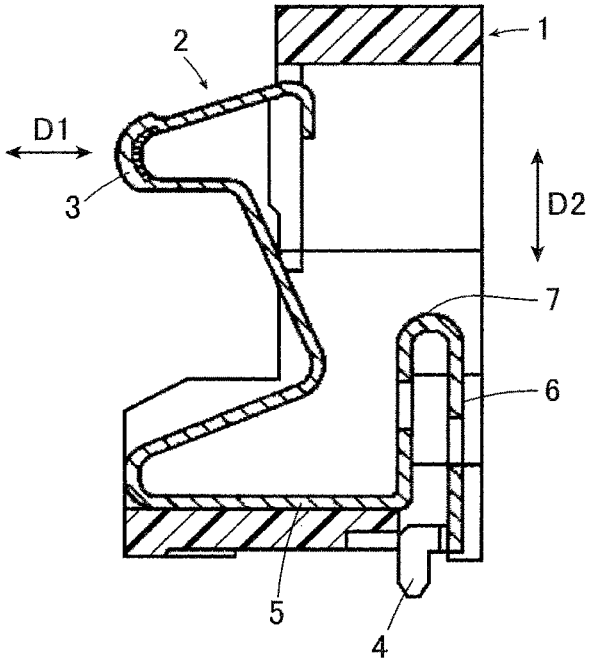
FIG. 21 PRIOR ART
FIG. 21 is a cross-sectional view of the conventional floating connector disclosed in JP 2010-118314 A.
Figure 22:
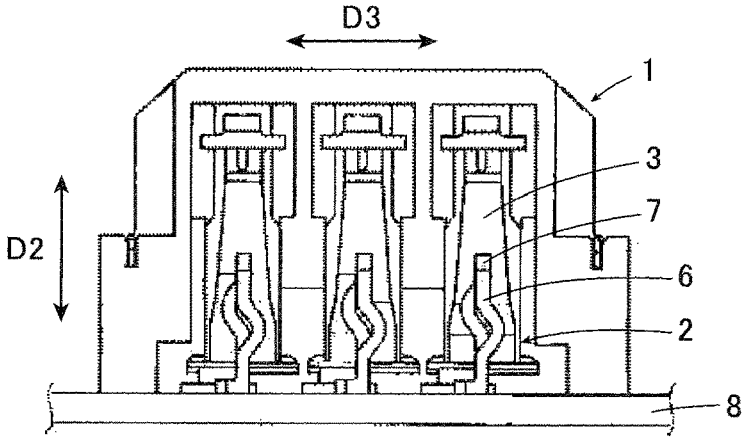
FIG. 22 PRIOR ART
FIG. 22 is a back view of the conventional floating connector disclosed in JP 2010-118314 A applied with no external force.
Figure 23:
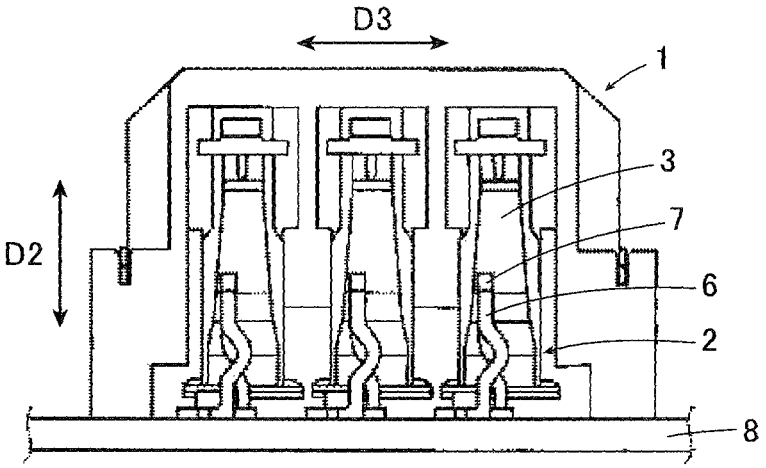
FIG. 23 PRIOR ART
FIG. 23 is a back view of the conventional floating connector disclosed in JP 2010-118314 A applied with an external force.

FIG. 19 illustrates the guide member 63 of the floating connector 61. As with the contact guide portions 12C formed on the base portion 12 of the floating connector 11 in Embodiment 1 as illustrated in FIGS. 1 to 4, the guide member 63 prevents the two contact portions 73C formed at the tip ends of the pair of branched portions 73B of the arm portion 73 from excessively shifting in the +Z direction.

As illustrated in FIG. 19, the guide member 63 of the floating connector 61 includes a surface 63A extending in parallel with the XY plane, and the guide member 63 is provided with a guide opening portion 63B corresponding to the body opening portion 64B of the connector body 62. Furthermore, the guide member 63 includes connector guide portions 63C separately extending in the −Z direction from the +Y directional end and the −Y directional end of the guide opening portion 63B. The guide member 63 also includes six bent portions 63D extending in the −Z direction from the +X directional end, the −X directional end and the +Y directional end of the guide member 63, and four extending portions 63E extending in the X direction toward the outside of the guide member 63 from the +X directional end and the −X directional end of the guide member 63. At a tip end of each of the four extending portions 63E, provided is a bending portion 65 extending in the X direction toward the outside of the guide member 63 as bending in the −Z direction.

As illustrated in FIGS. 16 and 17, the guide member 63 is fixed to the connector body 62 such that the surface 64A of the base portion 64 of the connector body 62 faces the surface 63A of the guide member 63. At this time, tips of the two connector guide portions 63C and the six bent portions 63D of the guide member 63 come into contact with the surface 64A of the base portion 64 of the connector body 62. In addition, the four extending portions 63E of the guide member 63 are independently inserted into the four fixing holes 64F of the connector body 62, while the bending portions 65 formed at the tip ends of the four extending portions 63E come into contact with the flat plate portions 64D of the connector body 62 from the −Z direction side. As a result, the guide member 63 is fixed to the connector body 62.

When the connector body 62 and the guide member 63 are fixed to each other in this manner, the pair of contact portions 73C of the connector body 62 are sandwiched between the surface 64A of the base portion 64 and the surface 63A of the guide member 63. Accordingly, the pair of contact portions 73C of the connector body 62 are prevented from excessively shifting in the +Z direction since the base portion 64 of the connector body 62 and the guide member 63 limit displacement of the pair of contact portions 73C in the Z direction. Because the distance between the surface 64A of the base portion 64 of the connector body 62 and the surface 63A of the guide member 63 is equal to the width in the Z direction of the bent portions 63D formed on the guide member 63, it is preferable that the width is slightly larger than the thickness of the pair of contact portions 73C of the connector body 62.

Moreover, when a contact of a counter connector (not shown) is inserted into the floating connector 61 along the fitting axis F, the contact of the counter connector may be diagonally inclined to the fitting axis F. In such a case, the two connector guide portions 63C of the guide member 63 work as a guide for insertion and withdrawal of the contact of the counter connector. In other words, since a tip end of the contact of the counter connector comes into contact with the connector guide portions 63C of the guide member 63, the contact of the counter connector can be smoothly fitted with the floating connector 61 without being caught to the inner peripheral part of the body opening portion 62B of the connector, body 62 and the inner peripheral part of the guide opening portion 63B of the guide member 63.

What is claimed is:

1. A floating connector that absorbs positional misalignment of a counter connector when the counter connector is fitted along a fitting axis, the floating connector being comprising:

a base portion;

a contact portion that comes into contact with the counter connector; and an arm portion that connects the base portion to the contact portion, wherein the arm portion includes an elastically deformable portion extending from the base portion in a direction parallel to the fitting axis, wherein a tip end of the arm portion extends in a direction intersecting the fitting axis, wherein the contact portion is formed at the tip end of the arm portion, and wherein the elastically deformable portion twists and deforms having the elastically deformable portion itself as a center, whereby the contact portion is floated in an arcuate motion within a plane perpendicular to the fitting axis.

2. The floating connector according to claim 1, wherein the elastically deformable portion is prevented from elastically expanding and contracting within a plane perpendicular to the fitting axis.

3. The floating connector according to claim 1, wherein the arm portion includes: a root portion extending from the base portion and including the elastically deformable portion; and a pair of branched portions extending from the root portion along a surface of the base portion, wherein the contact portion is formed at a tip end of each of the pair of branched portions, and wherein the contact portion of one of the pair of branched portions and the contact portion of the other of the pair of branched portions face each other across the fitting axis.

4. The floating connector according to claim 3, wherein the pair of branched portions flexibly deform to have their contact portions elastically displaced within a plane perpendicular to the fitting axis.

5. The floating connector according to claim 1, wherein the floating connector is composed of a single bent metal sheet, wherein the base portion extends in a direction perpendicular to the fitting axis, and wherein the arm portion is bent such that the base portion and the contact portion are located in parallel with each other.

6. The floating connector according to claim 1, further comprising a contact guide portion that prevents excessive displacement of the contact portion in a direction parallel to the fitting axis.

7. The floating connector according to claim 1, further comprising a connector guide portion to guide insertion and withdrawal of the counter connector.

8. An electronic device module comprising a plurality of floating connectors, each of which is the floating connector according to claim 1, wherein the contact portions of the plurality of floating connectors are independently electrically connected to a plurality of counter connectors in a garment-side connector, whereby the electronic device module is used as a wearable device.

* * * * *